US005933998A

United States Patent [19]

Plebani

[11] Patent Number: 5,933,998

[45] Date of Patent: Aug. 10, 1999

[54] BREAK-ACTION SHOTGUN WITH A DEVICE FOR MASS-PRODUCTION INTERCHANGEABILITY OF THE BARRELS

[75] Inventor: Dario Plebani, Ome, Italy

[73] Assignee: Franchi S.p.A., Italy

[21] Appl. No.: 08/954,718

[22] Filed: Oct. 20, 1997

[30] Foreign Application Priority Data

Feb. 26, 1997 [IT] Italy ..... MI97A0419

[51] Int. Cl.[6] ..... F41A 21/48

[52] U.S. Cl. ..... 42/75.04; 42/44

[58] Field of Search ..... 42/40, 75.04

[56] References Cited

U.S. PATENT DOCUMENTS

| | | | |
|---|---|---|---|
| 253,292 | 2/1882 | Johnson et al. | 42/40 |
| 452,126 | 5/1891 | Torkelson | 42/40 |
| 580,538 | 4/1897 | Whilden | 42/40 |
| 694,654 | 12/1902 | Lewis | 42/40 |
| 913,784 | 5/1909 | Taylor | 42/40 |
| 2,603,021 | 8/1952 | Paulve | 42/43 |
| 4,964,232 | 10/1990 | Mainland et al. | 42/44 |

*Primary Examiner*—Charles T. Jordan
*Assistant Examiner*—Denise J. Buckley
*Attorney, Agent, or Firm*—Sofer & Haroun, LLP

[57] ABSTRACT

A tensioning device used for achieving mass-production interchangeability of the barrels for a shotgun with articulated barrels is positioned between the barrels and the breech of the gun and comprises a rod-shaped element constituted by a fixed portion and a movable portion guided for moving on the fixed portion and subject to the action of a powerful spring which urges it against a tenon. Means are provided for adjustably engaging the rod-shaped element on the tenon.

4 Claims, 3 Drawing Sheets

BREAK-ACTION SHOTGUN WITH A DEVICE FOR MASS-PRODUCTION INTERCHANGEABILITY OF THE BARRELS

FIELD OF THE INVENTION

The present invention relates to a shotgun with articulated barrels (also known as a "break-action" gun) the barrels being articulated to the breech or rear portion of the gun.

The invention relates more particularly but not exclusively to a break-action shotgun of the type with under-and-over barrels.

BACKGROUND OF THE INVENTION

It is known that, in a break-action gun, particular care must be taken in the formation of the aforementioned articulated connection between the barrels and the breech since the achievement of the desired smooth opening of the gun which has to be guaranteed over time depends to a large extent thereon.

For such opening, it is necessary to achieve the correct, calibrated friction between the components of the articulated connection with a continuing capability to take up both play of the assembly and the play which is inevitably created by the use of the gun.

A rod-shaped tensioning element (called a bracing element by experts in the art) is generally used for this purpose and is engaged releasably on the gun barrel by means of a lever which engages a hooked projection formed on or fixed to the barrel. The stability of the aforesaid engagement, and hence the functional capacity of the bracing element, is achieved with great difficulty by means of successive operations to correct the hooked projection.

The tension or "pull" between the barrel unit and the breech of the gun and the value of the friction necessary for the stability of the gun during opening depend on the dimensions of the rod-shaped element or bracing element (its length and/or thickness) . A satisfactory tensioning and stability can be achieved only by successive operations to correct and calibrate the rod-shaped element.

Precisely because the aforesaid multiple mechanical operations require skilled intervention and successive adjustments carried out manually at workshop level by skilled operators, the barrel/breech/bracing-element assembly of a break-action gun can be considered as a unique, highly individualized unit. For this reason, in a break-action gun, interchangeability of the barrel unit produced specifically for that gun with other barrel units of the same type is not possible unless all of the above-mentioned mechanical operations and skilled interventions are repeated.

The main object of the invention is to design a device which provides for mass-production interchangeability of the barrel unit of a break-action shotgun with other barrel units of the same type, overcoming the technical and economic problems currently involved by the manual and exclusive operations which up to now have been necessary for the individualized adaptation of a barrel unit to a respective breech.

SUMMARY OF THE INVENTION

This and other objects which will become clearer from the following description are achieved by a device of the type mentioned above having the structural characteristics set out in the following claims.

BRIEF DESCRIPTION OF THE DRAWINGS

The characteristics and advantages of the invention will become clear from the description of an embodiment of a break-action shotgun incorporating a device according to the invention given below with reference to the appended drawings, provided by way of non-limiting example, in which.

DETAILED DESCRIPTION OF THE PREFERRED EMBODIMENT

Figure 1:
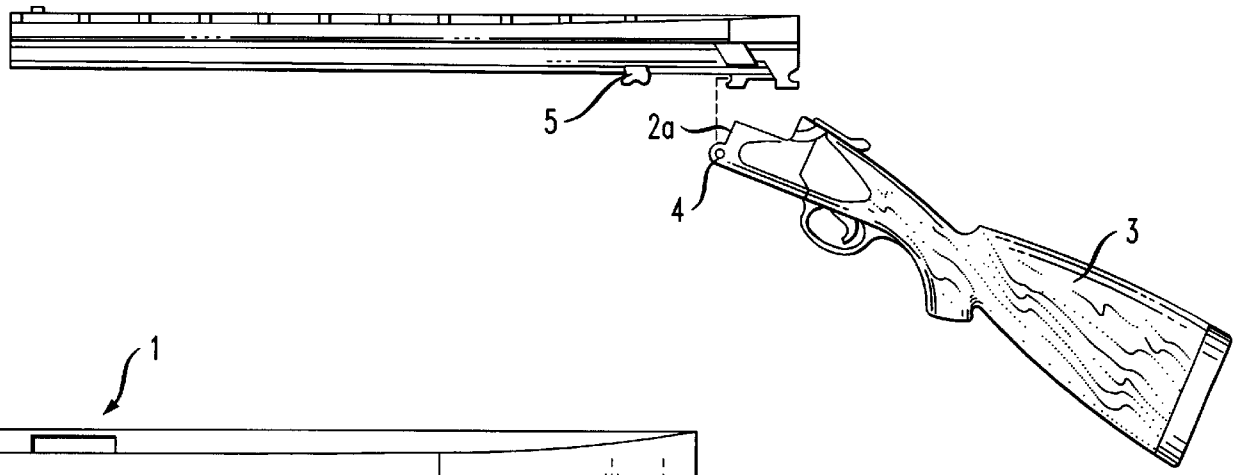
FIG. 1 is a side view with parts separated of a break-action shotgun of the type with under-and-over barrels.

With reference to the drawings, a break-action shotgun with under-and-over barrels comprises a barrel unit 1 articulated releasably to the front end 2*a* of a breech 2 which in turn is fixed to the stock 3 of the gun. This articulation is indicated in the drawings by the articulation generally indicated 4.

A plate-shaped tenon 5 of predetermined thickness, in the front end of which a hooked projection 6 is formed, is fixed to the lower barrel 1*a* of the barrel unit 1, in known manner.

A device generally indicated 7 provided for the so-called tensioning or "pulling" function between the barrel 1 and the breech 2 of the gun is engaged on the projection 6 in the manner described below.

Figure 3:
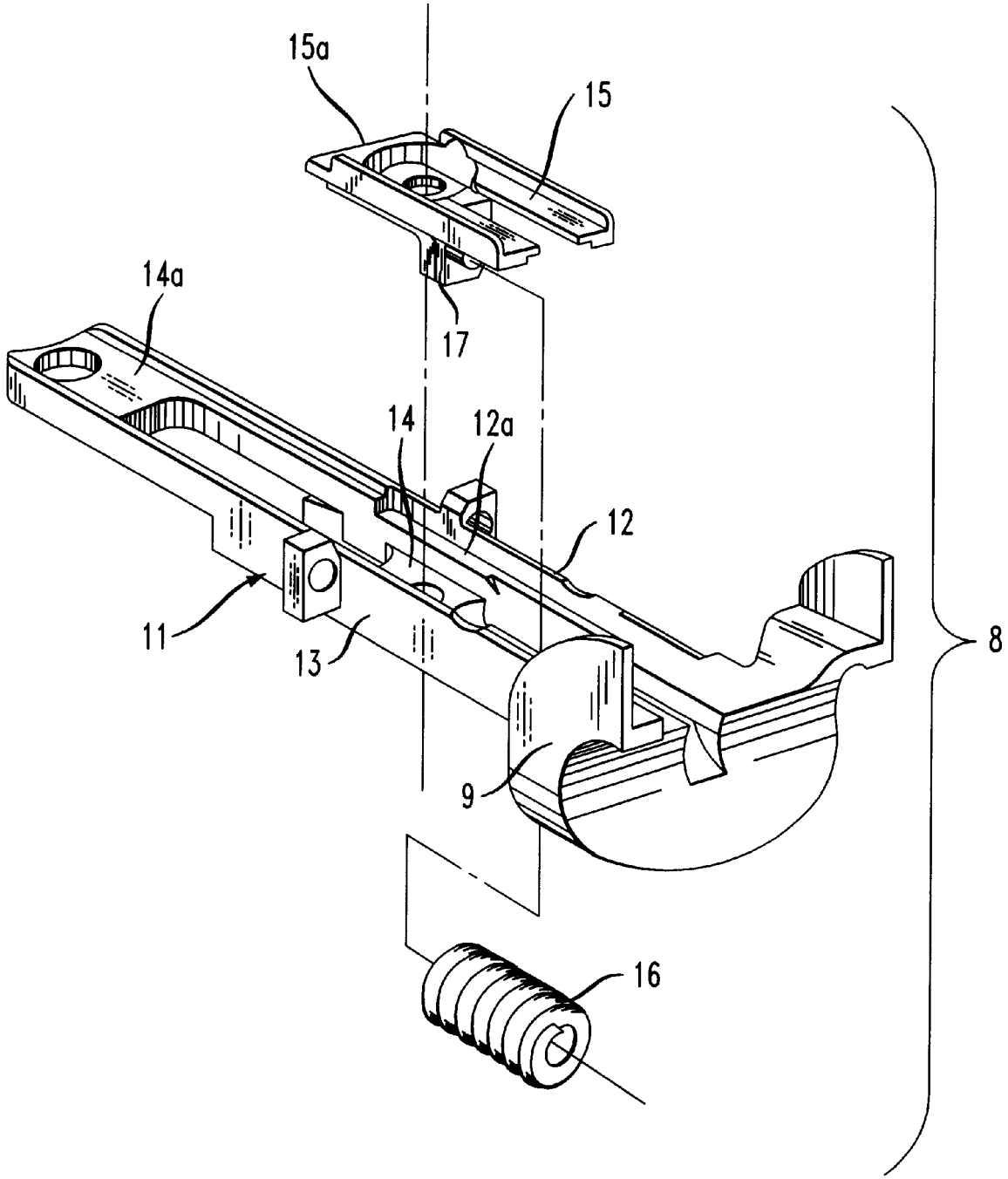
FIG. 3 is a perspective view of a detail of the device of FIG. 2 with parts separated and on an enlarged scale.
Figure 5:
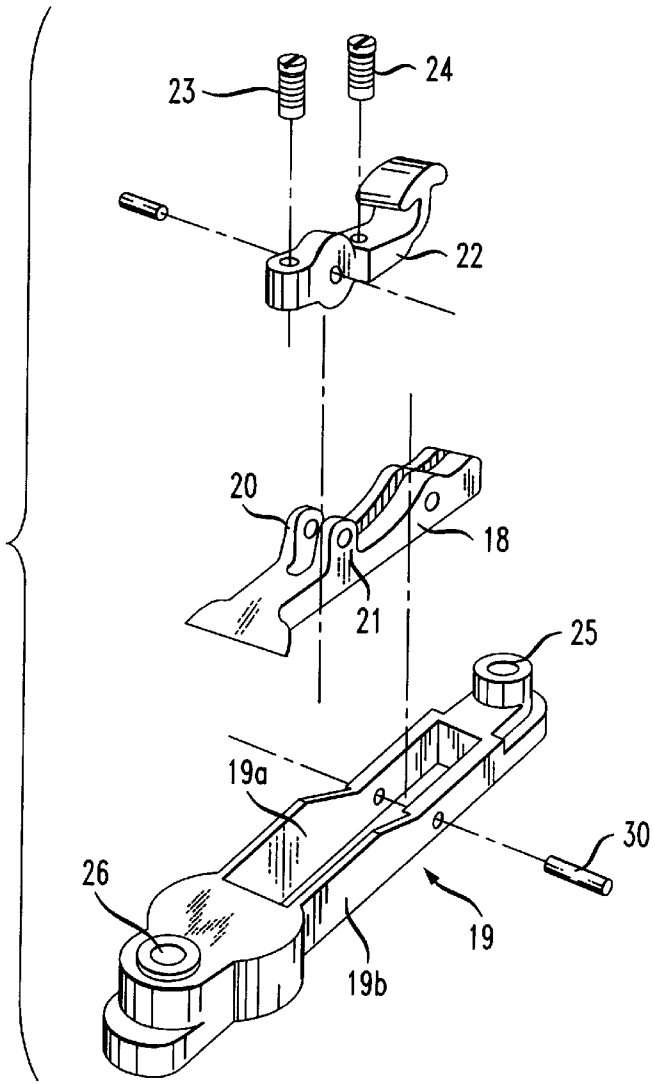
FIGS. 4 and 5 show another detail of the device of FIG. 2 in perspective and with parts separated respectively.
Figure 4:
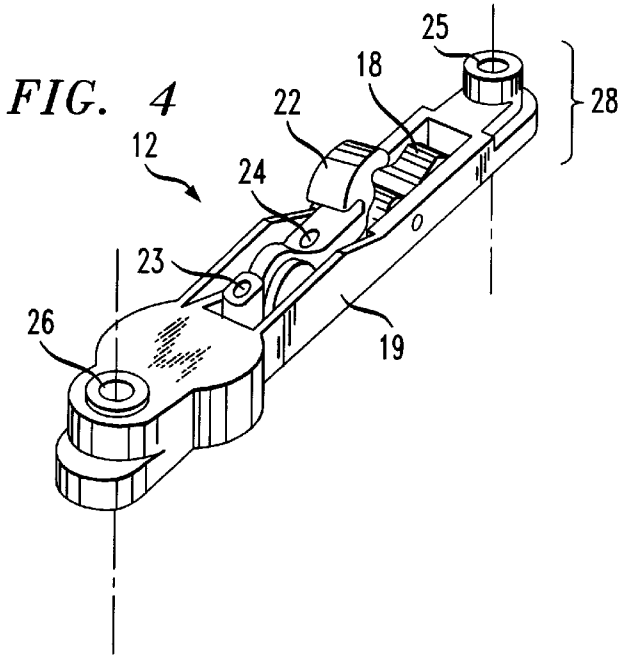

According to the present invention, the device 7 comprises a substantially rod-shaped element 8 (FIG. 3) called a "bracing element" by experts in the art, and a unit 28 (FIGS. 4 and 5) for engaging the rod-shaped element 8 on the tenon 5 and hence on the barrel unit 1.

The rod-shaped or bracing element 8 in turn comprises a head 9 formed integrally with or otherwise fixed to the end of a short shank 10 (FIG. 2), a straight rod 11 projecting from the shank 10, a slide 15 guided for sliding on the rod 11 and a spring 16 positioned between the head 9 and the slide 15 in order to urge it away from the head of the bracing element.

According to a preferred but not exclusive embodiment, the rod 11 is constructed substantially as a rectangular frame comprising two identical, parallel, flat rods 12, 13 connected to one another and spaced apart by an intermediate plate-shaped spacer 14 and an end plate-shaped spacer 14*a*. Respective flat, straight guides 12*a*, 13*a* are formed in the flat rods 12, 13 (only the guide 12*a* is visible in FIG. 3) the slide 15 being engaged for sliding thereon.

The slide 15 is preferably constituted by a plate, the front end 15*a* of which is intended to bear against the tenon 5. The plate also has a catch 17 which extends at right angles and on which the spring 16 acts.

According to a characteristic of the present invention, the spring 16 is very powerful, preferably exerting a load of about 200 kg. When the bracing element 8 is positioned between the articulation 4 and the tenon 5, the spring 16 urges the slide 15 (the movable part of the rod-shaped tensioning element 8) forcefully against the tenon 5, at the same time achieving the desired degree of "pull" between the barrel unit 1 and the breech 2, constantly and effectively taking up both the play in the assembly and the play due to the use of the gun.

Figure 6:
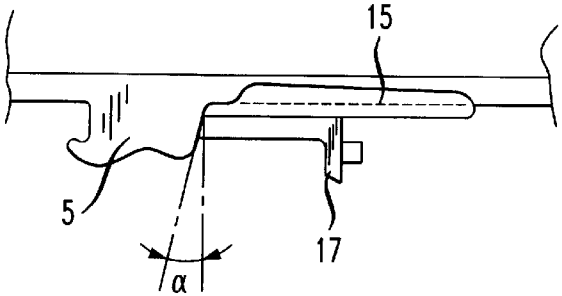
FIG. 6 is a view of another detail of the device of FIG. 2.

In fact the use of a rod-shaped element 8 formed by two parts (the rod 11 and the slide 15) of which a movable part (the slide 15) is subject to the action of a powerful spring 16 makes the rod-shaped element 8 an element of "variable length". This characteristic enables the barrel unit 1 of the break-action gun in question to be changed for another barrel unit of a similar type (mass-production interchangeability) without the need for numerous operations for adjusting and correcting its parts. On account of the power of the spring 16 (exerting a load of 200 kg), to facilitate the positioning of the bracing element 8, there is provision for the contact between the slide 15 and the tenon 5 to take place in a plane inclined by 7°–8.5° to the longitudinal axis of the bracing element 8 or in any case at an angle α (FIG. 6) smaller than the angle of steel/steel friction of the steel of which the slide and the tenon are made.

With regard to the engagement unit 28 (FIGS. 4 and 5), it comprises a lever 18 pivotable on the opposed walls 19*a*, 19*b* of a support base 19.

The lever 18 has a pair of lugs 20, 21 on which a hook 22 for engaging the hooked projection 6 of the tenon 5 is articulated. The angular position of the hook 22 relative to the lever 18 is adjustable by means of two grub screws 23, 24, the use of which fixes the hook 22 to the aforesaid lever 18.

Figure 2:
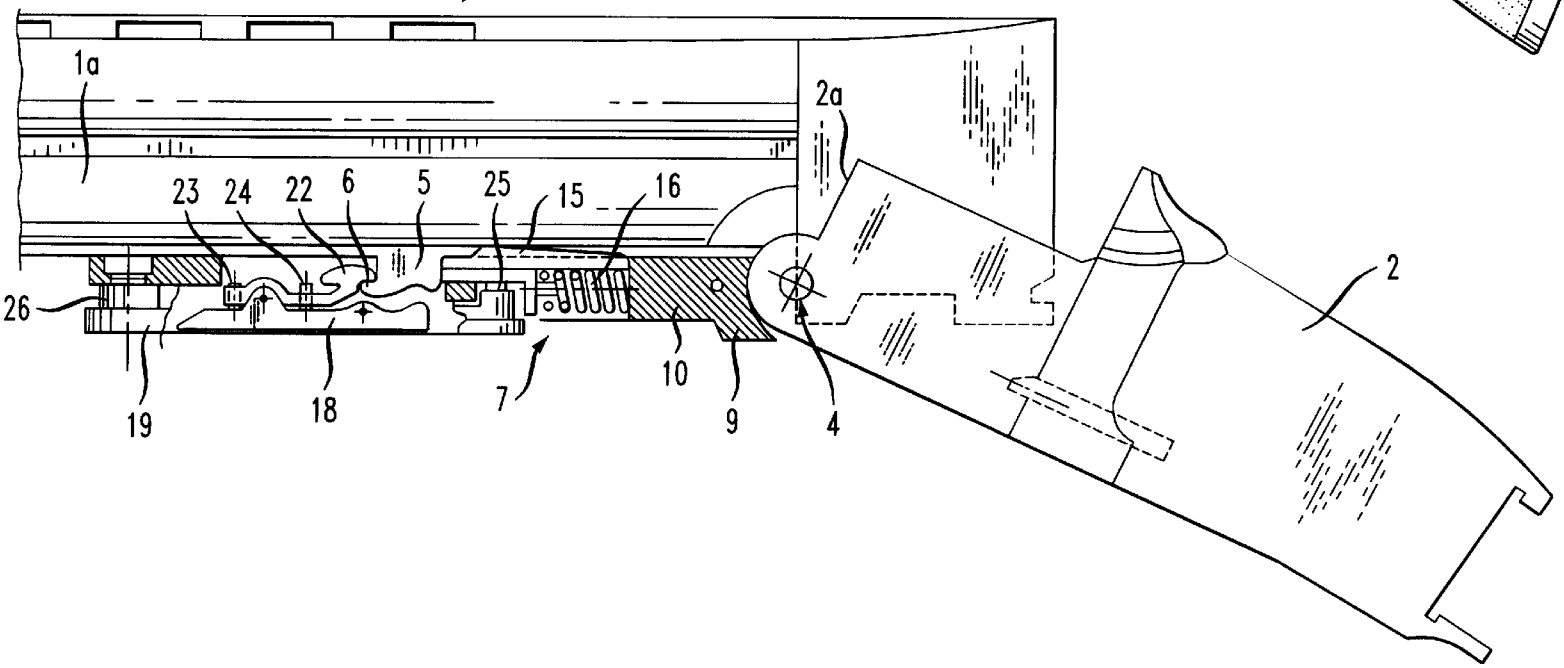
FIG. 2 shows schematically and in partial section a detail of the gun of FIG. 1 incorporating a device according to the invention.

The elongate base 19 has at its ends means 25, 26 for fixing it to the respective spacers 14 and 14*a* of the rod 11. It should be noted that the elongate base 19 is intended to be housed in the so-called fore-end of the shotgun in question from the exterior so that the lever 18 is accessible. Thus, after mounting the engagement unit 28 on the rod 11, via the end means 25 and 26 of the elongate base 19, the bracing element 8 can then be engaged on the barrel 2*a* of the gun by displacing the lever 18 around its pivot 30, whereby the hook 22 is caused to rotate and to disengage the projection 6 of the plate-shaped tenon 5 (FIG. 2).

The fact that the angular position of the hook 22 relative to the lever 18 can be varied adjustably enables the play in the assembly or due to wear to be taken up between the hook 22 and the hook formed by the tenon 5. That is, it enables the barrel unit 1 to be replaced (mass-production interchangeability) by another of the same type.

With the device of the present invention the tolerances of the bracing-element/housing/wooden fore-end assembly are cancelled out within the unit itself without requiring manual adjustment operations and without interfering with the barrel; the device of the present invention therefore renders the bracing-element/housing/fore-end unit adaptable to all barrels provided that they are identical; moreover, the gun opens smoothly and with guaranteed precision.

What is claimed is:

1. A shotgun with articulated barrels interchangeable with other mass-produced barrels, comprising:

a barrel unit having one or more barrels;

a breech connected to said barrel unit at an articulation point;

a plate shaped tenon fixed to said barrel of said barrel unit and having a hooked projection at its front;

a rod-shaped tensioning element positioned between said articulation point and said tenon, said rod-shaped tensioning element having a head detachably connected to said articulation point, a fixed portion connected to said head, a moveable portion configured to slide on said fixed portion relative to said barrel unit, said tensioning element further having a spring positioned between said head and said moveable portion so that said moveable portion is urged by said spring against said tenon; and means for releasably engaging said tensioning element from said tenon.

2. A shotgun according to claim 1, wherein said fixed portion comprises a straight rod fixed to and projecting from said head and having straight guides for the sliding engagement of said moveable portion.

3. A shotgun according to claim 2, wherein said moveable portion comprises a substantially plate-shaped slide having an end which is intended to come into planar contact with said tenon, said slide having a catch for engagement with said spring.

4. A shotgun according to claim 1, wherein said means for releasably engaging said tensioning element from said tenon comprises a lever pivotable on a support base, a hook which is articulated on a pair of lugs of said lever and which can engage said hooked projection of said tenon, and two grub screws for adjusting the angular position of said hook relative to said lever.

* * * * *